US008973504B2

(12) United States Patent
Kim

(10) Patent No.: US 8,973,504 B2
(45) Date of Patent: Mar. 10, 2015

(54) BULLET INCLUDING AN AIR-GUIDING RECESS

(75) Inventor: Jun-Kyu Kim, Daejeon (KR)

(73) Assignee: Duretek Inc., Daejeon (KR)

( * ) Notice: Subject to any disclaimer, the term of this patent is extended or adjusted under 35 U.S.C. 154(b) by 11 days.

(21) Appl. No.: 13/819,690

(22) PCT Filed: Apr. 29, 2011

(86) PCT No.: PCT/KR2011/003223
§ 371 (c)(1),
(2), (4) Date: Apr. 3, 2013

(87) PCT Pub. No.: WO2012/030048
PCT Pub. Date: Mar. 8, 2012

(65) Prior Publication Data

US 2013/0180424 A1 Jul. 18, 2013

(30) Foreign Application Priority Data

Aug. 30, 2010 (KR) ..... 10-2010-0083800

(51) Int. Cl.
*F42B 10/44* (2006.01)
*F42B 10/38* (2006.01)

(52) U.S. Cl.
CPC ..... *F42B 10/44* (2013.01)
USPC ..... 102/501; 102/490; 244/3.23

(58) Field of Classification Search
CPC ..... F42B 10/24; F42B 10/38; F42B 10/42; F42B 10/44
USPC ..... 102/439, 490, 501; 244/3.23, 3.24
See application file for complete search history.

(56) References Cited

U.S. PATENT DOCUMENTS

| | | | | | |
|---|---|---|---|---|---|
| 760,338 | A | * | 5/1904 | Kwiatkowski | 244/3.23 |
| 1,241,409 | A | * | 9/1917 | Lizarraga | 102/501 |
| 3,873,048 | A | * | 3/1975 | Platou | 244/3.1 |
| 4,063,511 | A | | 12/1977 | Bullard | |
| 4,176,487 | A | * | 12/1979 | Manis | 42/76.01 |
| 4,813,635 | A | * | 3/1989 | Paterson et al. | 244/130 |
| 5,070,791 | A | * | 12/1991 | Dineen et al. | 102/517 |
| 5,133,261 | A | | 7/1992 | Kelsey, Jr. | |

FOREIGN PATENT DOCUMENTS

| | | | |
|---|---|---|---|
| JP | 1991-221795 | A | 9/1991 |
| KR | 10-2007-0075411 | A | 7/2007 |

OTHER PUBLICATIONS

International Search Report for PCT/KR2011/003223 filed on Apr. 29, 2011.

* cited by examiner

*Primary Examiner* — James S Bergin

(57) ABSTRACT

The present invention relates to a bullet including an air-guiding recess, comprising: a head 20; and a tail 30 disposed behind the head 20, and including an odd number of air-guiding recesses 32 formed so as to be curved in the bottom and outer circumferential surfaces thereof. The air-guiding recess 32 is characterized by having a sloped bottom that increases in depth while progressing to the bottom surface of the tail 30. Accordingly, vortex is prevented from being generated at the rear side of the bullet, so as to significantly increase the effective range thereof and simultaneously improve accuracy when shooting same.

6 Claims, 5 Drawing Sheets

PRIOR ART

BULLET INCLUDING AN AIR-GUIDING RECESS

TECHNICAL FIELD

The present invention relates to a bullet, and particularly, to a bullet which can minimize generation of vortex when being shot from a gun or a cannon, thereby increasing the effective range thereof and also improving accuracy rate.

BACKGROUND ART

In general, ammunition consists of a bullet which functions as a projectile, a propelling charge which functions as a propellant, a percussion cap which ignites the propelling charge, and a cartridge case which covers the bullet, propelling charge and percussion cap.

Especially, when the bullet is shot from a gun or a cannon, it is propelled by high pressure gas generated by combustion of the propelling charge, thereby having the effect of casualty and destruction using its penetration and fragments.

Initially, the bullet was developed and researched with an emphasis on its killing power. However, in modem times, it has been researched with an emphasis on improving of its functions such as effective range and accuracy rate.

As shown in FIG. 1, a conventional bullet 10 consists of a head part 2, and a tail part 4 which is extended to the rear side of the head part 2 and formed into a streamline shape. Since the bullet 10 has the streamlined tail part 4, it is possible to efficiently prevent irregular air-flow like vortex which may generate at the rear side of the bullet 10 during flight. However, due to the streamlined tail part 4, a bottom surface of the bullet, which receives an impelling force in a gun barrel, becomes too small and thus the propelling efficiency of the bullet is reduced. Further, there is another problem in that a length of the bullet 10 becomes excessively longer.

In FIG. 2, a bullet which is developed in order to solve the problems is shown. The bullet 10 consists of a head part 2 and a tail part 4 which is extended to the rear side of the head part 2 and formed into a boat-tail shape. Since the tail part 4 has the boat-tail shape, it is possible to satisfy the problem of the impelling force in the gun barrel to a certain degree, but there is another problem in that irregular air-flow like vortex is generated at the rear side of the tail part 4.

And in case of a bullet disclosed in Korean Patent No. 0437008, the bullet has a guiding body for inducing an air flow, and an inclined groove is formed in the outer surface of the guiding body.

Accordingly, the bullet shot from a gun is rotated right along fringing grooves, and then from a point of time when the bullet leaves the gun, rotational force which rotates the bullet left is applied to the bullet by the inclined groove. Thus, it is prevented that a trajectory of the bullet is curved right by centrifugal force, and thus the effective range of the bullet is relatively increased. The fringing grooves are spiral grooves formed inside the gun barrel. The fringing grooves function to provide stability to the bullet during flight and also provide rotational force necessary to increase destructive power of the bullet.

Meanwhile, as shown in FIG. 4, the center of pressure (CP) of a bullet is spaced apart from the center of gravity (CG) thereof and located between the CG and a front end of the bullet. Therefore, when the bullet is moved in the air, a yaw moment is generated as shown in FIG. 3, and thus a yaw angle is formed between a trajectory of the bullet and a symmetry axis which connects center points of the CP and CG Since the yaw angle has a large influence on the flight stability of the bullet, the bullet disclosed in Korean Patent No. 0437008 has an effect which increases the effective range thereof, but there is a problem that in that the yaw angle is increased during flight of the bullet and thus the accuracy rate is reduced.

Further, since the rotational force generated by the fringing grooves is offset by that of the inclined groove of the guiding body, the flight stability and the destructive power are deteriorated.

And since the guiding body has a flat rear surface, it is not possible to reduce or remove vortex generated at the rear side of the bullet during flight of the bullet, and thus the flight stability of the bullet is lowered and also it is limited to improve the effective range of the bullet.

DISCLOSURE

Technical Problem

An object of the present invention is to provide a bullet which can increase rotational force during flight, can reduce remarkably vortex generated at the rear side of the bullet, and also can reduce a yaw angle, thereby improving the flight stability and increasing the accuracy rate.

Technical Solution

To achieve the object of the present invention, the present invention provides a bullet having air guiding recesses, comprising a head part; and a tail part which is located at the rear side of the head part and formed with an odd number of air guiding recesses formed at outer and lower surfaces thereof to be curved, wherein each of the air guiding recesses has an inclined bottom so that a depth of the air guiding recess is gradually increased toward the lower surface of the tail part.

Preferably, each of the multiple air guiding recesses has an angle θ with respect to a line which connects a center point of the lower surface of the tail part and a center of the air guiding recess which is formed at the outer surface of the tail part.

Preferably, each of the air guiding recesses has the same width over the outer and lower surfaces of the tail part.

Preferably, three air guiding recesses are formed at the outer and lower surfaces of the tail part 30 so as to be spaced apart from one another at regular intervals.

Advantageous Effects

According to the present invention, since air is forcibly guided to the center area of the tail part by the air guiding recesses formed at the tail part to have a predetermined depth, it is possible to easily and effectively restrain the vortex generated at the rear side of the tail part and thus increase the flight stability of the bullet, thereby improving the effective range and the accuracy rate.

Further, since the mass of the tail part is reduced due to the air guiding recesses of the tail part, the center of gravity of the bullet is moved to the center of pressure thereof, and thus it is possible to considerably reduce the yaw angle generated during the flight of bullet, thereby improving the flight stability and accuracy rate of the bullet. Further, since the plurality of air guiding recesses are formed to be curved, the rotational force is applied to the bullet by the air guided through the air guiding recesses, thereby increasing the destructive power of the bullet.

And since the propellant gas is previously discharged at the end of the shooting body (e.g., the muzzle of a gun) through the air guiding recesses, the shooting shock is remarkably reduced.

DESCRIPTION OF DRAWINGS

The above and other objects, features and advantages of the present invention will become apparent from the following description of preferred embodiments given in conjunction with the accompanying drawings, in which.

BEST MODE

Hereinafter, the embodiments of the present invention will be described in detail with reference to accompanying drawings.

Figure 1:
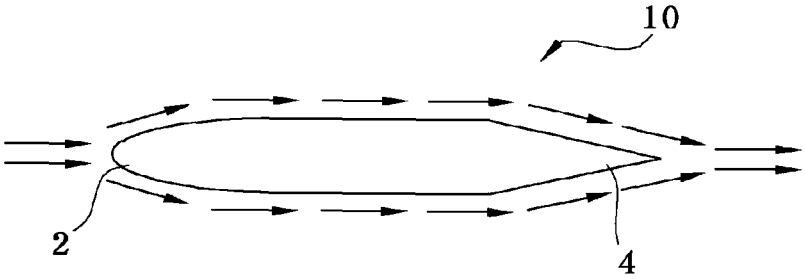
FIG. 1 is a side view of a conventional bullet.
Figure 2:
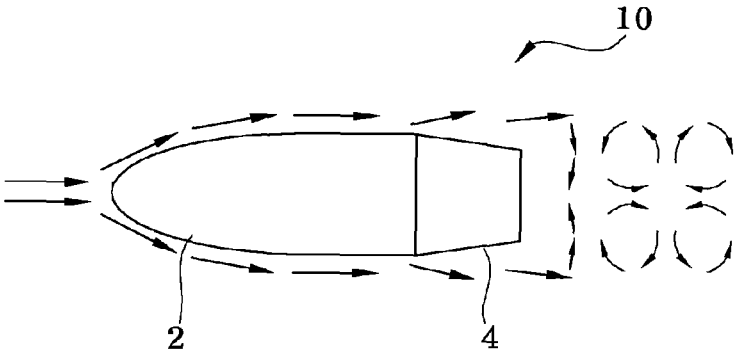
PRIOR ART Figure 2
FIG. 2 is a side view of another conventional bullet.
Figure 3:
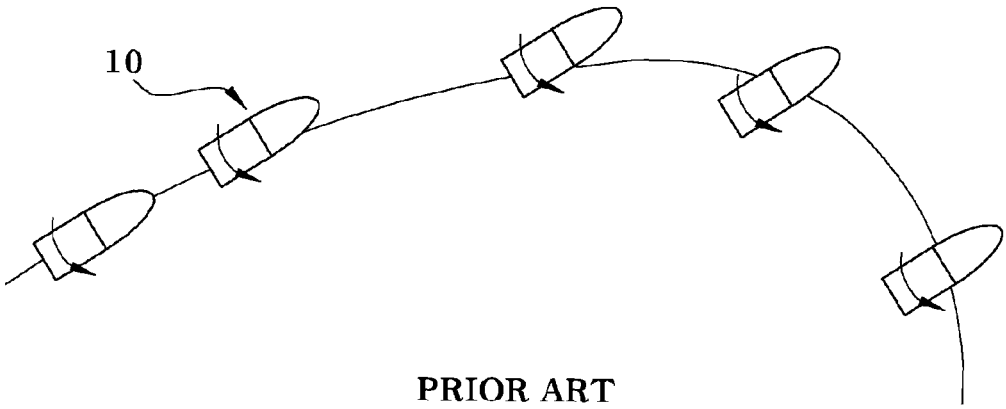
PRIOR ART Figure 3
FIG. 3 is a schematic view showing force applied to a bullet.
Figure 4:
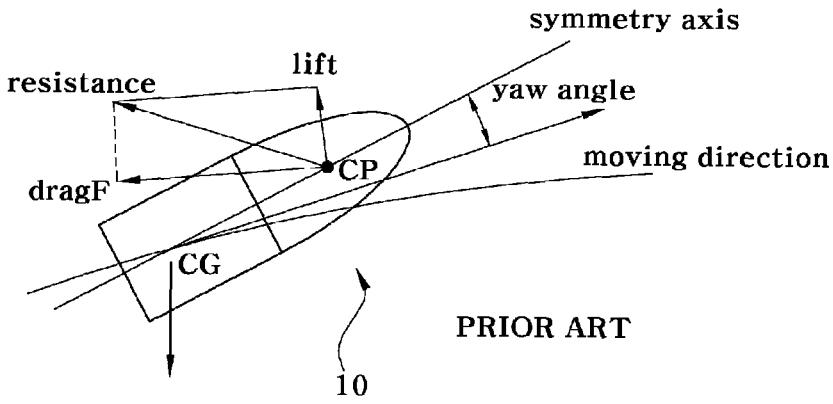
FIG. 4 is a schematic view showing a moving state of a bullet when the bullet is excessively rotated.
Figure 5:
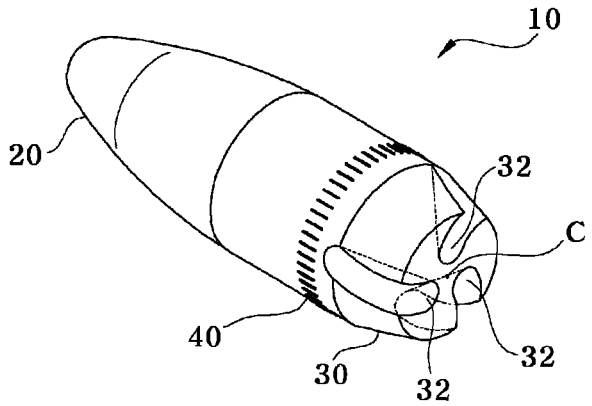
FIG. 5 is a perspective view of a bullet according to the present invention.
Figure 6:
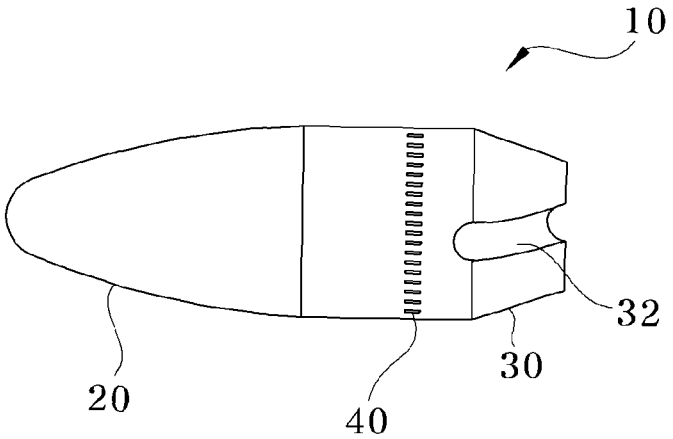
FIG. 6 is a side view of the bullet according to the present invention.

As shown in FIGS. 5 and 6, a bullet 10 according to the present invention consists of a head part 20, and a tail part 30 which is formed at the rear side of the head part and formed with air guiding recesses 32.

The head part 20 formed at the front side of bullet has a streamlined front end in order to reduce air resistance during flight of the bullet.

The tail part 30 is integrally formed with the head part 20 and formed into a boat-tail shape which is inclined at about 6-8° with respect to a center axis of the bullet in order to allow air to be smoothly flowed during the flight of the bullet and also to minimize generation of vortex at the rear side of the bullet.

Since the boat-tail shape of the bullet is well-known already, the structure and effect thereof will be omitted.

The air guiding recesses 32 formed at the tail part 30 function to guide the air flow on a surface of the bullet.

The air guiding recesses 32 are formed in an odd number at outer and lower surfaces of the tail part 30. Each of the air guiding recesses 32 has an inclined bottom so that a depth of the air guiding recess 32 is gradually increased toward the lower surface of the tail part 30. Thus, during the flight of the bullet, the air flow is forcibly guided to the center area of the lower surface of the tail part 30, thereby efficiently restraining irregular air flow, i.e., vortex generated at the rear side of the bullet 10.

If the air guiding recesses 32 are formed at the tail part 30, as described above, air is guided and flowed through the air guiding recesses 32. Herein, it is necessary to maintain balance among the guided air flows. It is easy to maintain the balance when the air guiding recesses 32 are formed in an odd number, and thus the flight stability of the bullet is kept.

Each of the air guiding recesses 32 which is formed at the outer and lower surfaces of the tail part 30 has the same width over the whole length thereof so that the air flow guided by the air guiding recesses 32 is stabilized therein.

And in order to more effectively restrain the generation of vortex, it is preferable that each end of the air guiding recesses 32 formed at the lower surface of the tail part 30 is located to be adjacent to the center point of the tail part 30.

Figure 7:
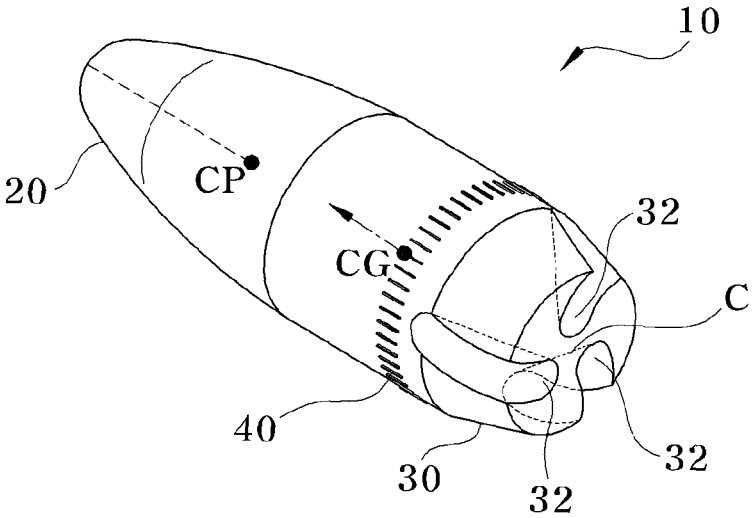
FIG. 7 is a perspective view showing a state that the center of gravity of the bullet is moved according to the present invention.

The air guiding recesses 32 also function to minimize a yaw angle occurred during the flight of the bullet 10, thereby securing the flight stability of the bullet 10. In other words, since the multiple air guiding recesses 32 are formed at the outer surface of the bullet 10, the entire mass of the tail part 30 is reduced, and as shown in FIG. 7, the center of gravity (CG) located at the rear side of the bullet 10 is moved toward the center of pressure (CP), and thus it is possible to reduce a yaw moment generated during the flight of the bullet 10 and also to remarkably reduce the yaw angle. By restraining the generation of vortex and reducing the yaw moment and yaw angle, flight ability of the bullet 10 is improved, and thus it is possible to considerably increase the effective range as well as the accuracy rate.

Figure 8:
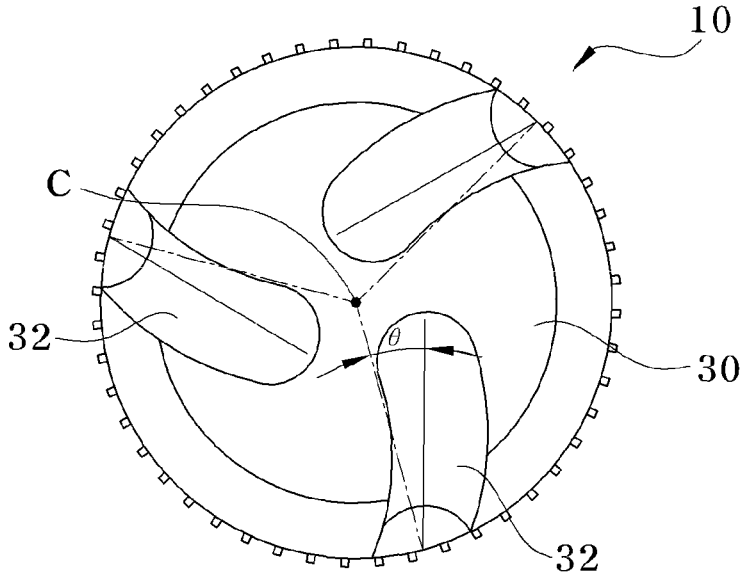
FIG. 8 is a lower view enlargedly showing a structure of an air guiding recess formed at a tail part of the bullet according to the present invention.
Figure 9:
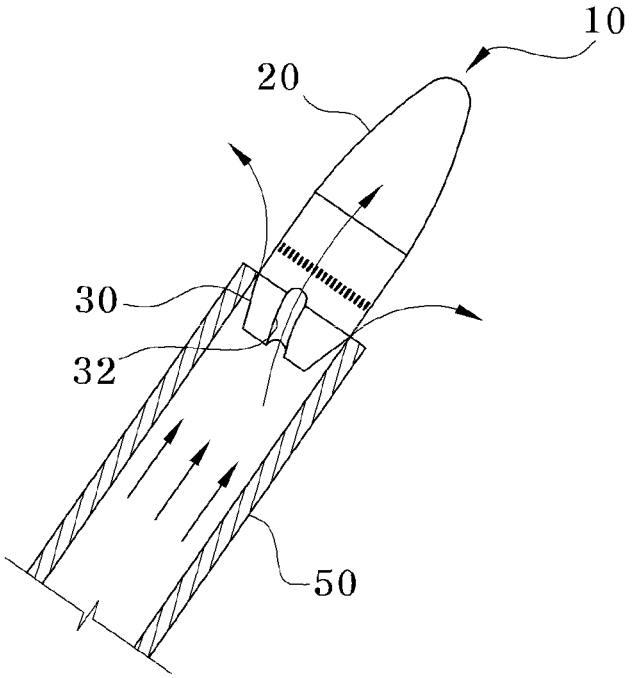
FIG. 9 is a schematic view showing a state that a bullet is discharged from a muzzle according to the present invention.

As shown in FIG. 8, each of the air guiding recesses 32 formed at the tail part 30 is curved in order to rotate the bullet using the air flow. Each curved air guiding recess 32 has an angle θ with respect to a line which connects the center point C of the lower surface of the tail part 30 and the center of the air guiding recess 32 which is formed at the outer surface of the tail part 30, such that each end of the air guiding recesses 32 is not directed to the center point C of the lower surface of the tail part 30. In case that the air guiding recesses 32 are not directed to the center point C of the lower surface of the tail part 30, the air flows guided by the air guiding recesses 32 are collided with one another at the center point C, and thus the air flows are disturbed at the rear side of the bullet 10, thereby deteriorating the flight stability of the bullet 10.

As described above, due to the figural and structural features of the air guiding recesses 32, it is prevented that the vortex is generated at the rear side of the bullet 10, and also the rotational force of the bullet 10 is additionally provided by the air flows guided by the air guiding recesses 32, thereby increasing the destructive power of the bullet 10.

A curvature of each of the air guiding recesses 32 can be properly adjusted within the extent that the air flow guided by the air guiding recesses 32 can provide the rotational force to the bullet 10.

Preferably, three air guiding recesses 32 are formed in the outer surface of the tail part 30 at regular intervals, and each of them has the same length, width and depth in order to provide the uniform air flows.

In order to decide the number of air guiding recesses 32 formed at the bullet 10, the applicant prepared test bullets 10 each of which has 3 to 6 air guiding recesses 32, performed a wind tunnel test using them and then observed a generation state of vortex at the rear side of the bullet 10. As a result, it was confirmed that the generation of vortex was minimized when having three air guiding recesses 32.

If the bullet 10 formed with the air guiding recesses 32 as described above is shot from a gun, propellant gas is previously discharged through the air guiding recesses 32 when the bullet 10 leaves the muzzle of the gun, and thus pressure in the gun barrel is sharply reduced. Therefore, a shooting shock is remarkably reduced.

Meanwhile, a reference numeral 40 which is not described is a cartridge belt. The cartridge belt 40 is a belt which is formed of a soft metal and formed along the outer surface of the bullet 10 so that the bullet 10 can be spun with relation to the fringing groove formed in the gun barrel.

Figure 10:
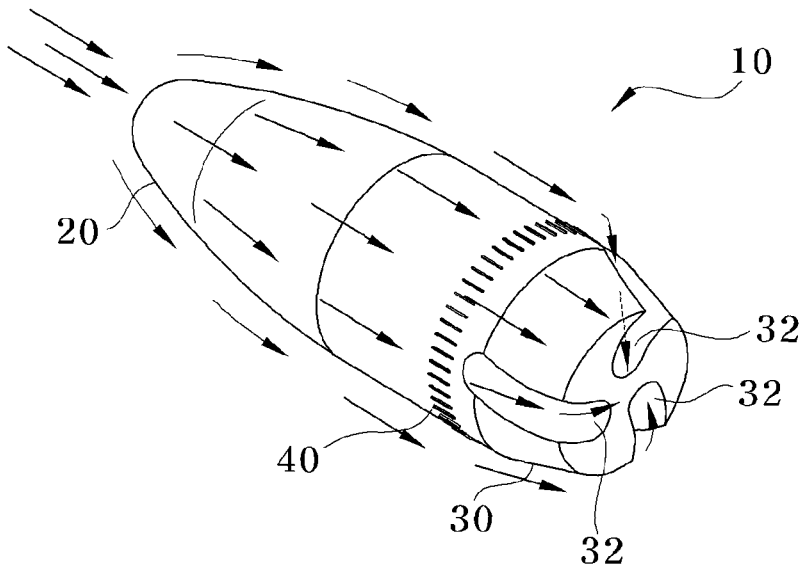
FIG. 10 is a perspective view showing an air flow generated during flight of the bullet according to the present invention.

The air flow generated during the flight of the bullet 10 having the configuration as described above will be described with reference to FIG. 10.

When the bullet 10 is shot from a gun, the air flow is generated along the surface of the bullet 10, and part of the air flow passing through the streamlined head part 20 of the bullet 10 is guided to the multiple air guiding recesses 32 formed at the outer surface of the tail part 30.

Herein, the air flow guided to the air guiding recesses 32 is flowed at the angle θ and guided to the center area of the lower surface of the bullet 10, thereby restraining the generation of the irregular air flow like vortex at the rear side of the bullet 10.

INDUSTRIAL APPLICABILITY

According to the present invention as described above, since air is forcibly guided to the center area of the tail part by the air guiding recesses formed at the tail part to have a predetermined depth, it is possible to easily and effectively restrain the vortex generated at the rear side of the tail part and thus increase the flight stability of the bullet, thereby improving the effective range and the accuracy rate.

Further, since the mass of the tail part is reduced due to the air guiding recesses of the tail part, the center of gravity of the bullet is moved to the center of pressure thereof, and thus it is possible to considerably reduce the yaw angle generated during the flight of bullet, thereby improving the flight stability and accuracy rate of the bullet.

Further, since the plurality of air guiding recesses are formed to be curved, the rotational force is applied to the bullet by the air guided through the air guiding recesses, thereby increasing the destructive power of the bullet.

And since the propellant gas is previously discharged at the end of the shooting body (e.g., the muzzle of a gun) through each of the air guiding recesses, the shooting shock is remarkably reduced.

While the present invention has been described with respect to the specific embodiments, it will be apparent to those skilled in the art that various changes and modifications may be made without departing from the spirit and scope of the invention as defined in the following claims.

The invention claimed is:

1. A bullet, comprising:

a head part; and a tail part integrated with the head part and including an odd number of air guiding recesses formed along outer surfaces and a bottom surface thereof, the recesses being curved, wherein each of the air guiding recesses has a depth that gradually increases toward the bottom surface of the tail part, and wherein each of the air guiding recesses has the same width over the outer surfaces and the bottom surface of the tail part.

2. The bullet according to claim 1, wherein each of the air guiding recesses has an angle θ with respect to a line that connects a center point of the bottom surface of the tail part and a center of the air guiding recess at the outer surface of the tail part, such that each end of the air guiding recesses is not directed to the center point of the lower surface of the tail part.

3. The bullet according to claim 2, wherein each recess defines a curved shape in the bottom surface of the tail part, the curved shape of the recess extending from a perimeter of the bottom surface to an area proximate to a center point of the bottom surface.

4. The bullet according to claim 1, wherein three air guiding recesses are formed along the outer and bottom surfaces of the tail part and are spaced apart from one another at regular intervals.

5. The bullet according to claim 1, further comprising:

a cartridge belt including a plurality of grooves disposed in a part between the head part and the tail part along a circumference of the bullet, wherein the part including the cartridge belt, the head part, and the tail part are integrated in a unified streamlined body.

6. The bullet according to claim 1, wherein each of the air guiding recesses has a predetermined length along the bottom surface of the tail part so that air flowing along outer surfaces of the bullet is guided from the outer surface of the tail part to a center area at the bottom surface of the tail part.

* * * * *